United States Patent [19]

Bercu

[11] Patent Number: 4,704,944

[45] Date of Patent: Nov. 10, 1987

[54] SEMI-AUTOMATIC PISTOL

[75] Inventor: Iancu Bercu, Petah-Tikva, Israel

[73] Assignee: The State of Israel, Ministry of Defence, Military Industries of Israel, Ramat-Hasharon, Israel

[21] Appl. No.: 884,665

[22] Filed: Jul. 11, 1986

Related U.S. Application Data

[63] Continuation of Ser. No. 568,628, Jan. 6, 1984, abandoned.

[51] Int. Cl.[4] ..... F41D 11/04

[52] U.S. Cl. ..... 89/132; 89/194; 89/199

[58] Field of Search ..... 42/69.02; 89/132, 194, 89/195, 196, 197, 199

[56] References Cited

U.S. PATENT DOCUMENTS

| | | | |
|---|---|---|---|
| 1,143,472 | 6/1915 | Whiting | 89/196 |
| 1,226,478 | 5/1917 | Diehm | 42/69 A |

FOREIGN PATENT DOCUMENTS

| | | | |
|---|---|---|---|
| 535530 | 1/1922 | France | 89/196 |
| 93866 | 4/1960 | Netherlands | 194/ |

*Primary Examiner*—Stephen C. Bentley
*Attorney, Agent, or Firm*—Browdy and Neimark

[57] ABSTRACT

A semi-automatic pistol comprises a spring driven mobile striker assembly. At its rear the spring is coiled on a post and abuts an aft stationary plate. The striker assembly comprises an integral rear plate with a hole adapted for the penetration of the post and spring and having at the front side of the hole a hollow cylindrical sleeve adapted to accommodate the post and spring during recoil.

5 Claims, 3 Drawing Figures

SEMI-AUTOMATIC PISTOL

This application is a continuation of application Ser. No. 568,628, filed 01/06/84, now abandoned.

The present invention generally relates to firearms and more particularly to a high performance semi-automatic pistol.

In recent years in the firearm industry the name Uzi has been associated with a certain type of machine gun which was used by the Israeli army. The reputation of the Uzi firearm was that it is simple in construction, and thus easily assembled and disassembled and operable under adverse conditions. For several years a 9 mm Uzi semiautomatic carbine has been sold in large numbers in the U.S. The dimensional features of the Uzi carbine from fore to aft are a barrel, main body and collapsible butt of respective dimensions of 210 mm, 370 mm and 215 mm.

When attempting to convert the Uzi carbine into a pistol type firearm it was recognized that this can only be achieved if the length of the body of the carbine was reduced to a minimum. This basic minimum is defined by the minimal length of the bolt and its minimal travel distance as well as by the configuration of the body itself and that of the striker assembly It was recognized that if the body length could be reduced sufficiently, say on the order of 200–250 mm one could then dispense with the butt and convert the Uzi carbine into an Uzi pistol.

The present invention is directed to the discovery made to provide a short enough body to be used to form a pistol which has substantially all the characteristics of the Uzi carbine, except in pistol form. Briefly, three basic changes were made, the major one being related to the striker assembly. This change will be described hereafter in detail. The other two relate to the elimination of a block at the aft end of the body and to shortening the bolt without affecting its performance. With these basic changes a body of a length of about 210 mm could be used. Such body length is adequate for a semi-automatic pistol.

The novel features of the invention are set forth with particularity in the appended claims. The invention will best be understood from the following description when read in conjunction with the accompanying drawings.

As is appreciated by those familiar with firearms, such as the Uzi carbine, in a semi-automatic firearm except for initial arming, when the trigger is pressed, the sear lever frees the striker assembly. The latter is spring biased by a striker assembly return spring to be driven toward the fore end of the weapon whereat a bullet to be fired has been lodged in the bore. As the striking or firing pin, provided on the striker assembly, hits the bullet's detonator it causes the shell to be fired. The gases drive the bolt aft until the force of a bolt retain, spring drives the bolt forward. The bolt feeds a new bullet from the magazine into the chamber and places it in the firing position. As to the striker assembly the bolt drives it aft. However whereas the bolt is free to move fore, the sear lever prevents the striker assembly from moving fore until the trigger is pressed once more.

Figure 1:
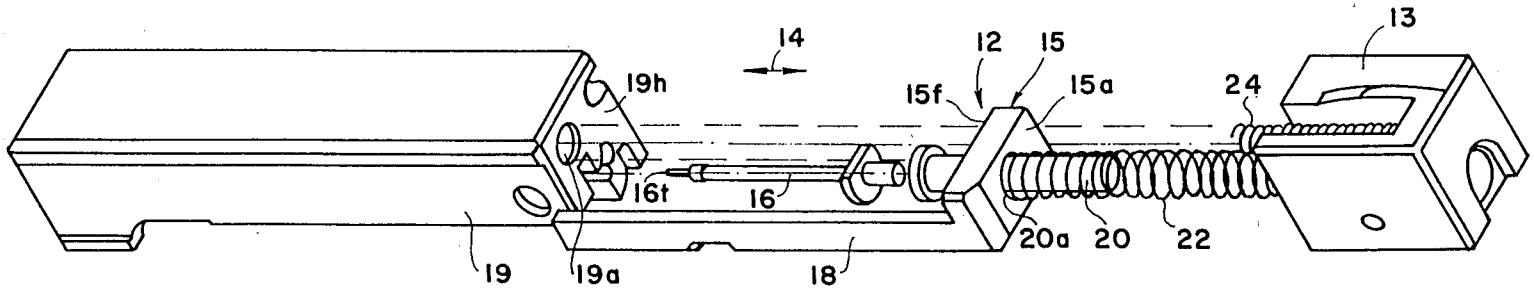
FIG. 1 is an expanded view of the bolt, striker assembly and an aft block typical of the prior art 9 mm Uzi carbine.

Attention is now directed to FIG. 1 in which the striker assembly 12 and a rear block 13 which are part of the Uzi carbine, i.e. prior art, are diagrammed. The striker assembly 12 includes a plate 15 which is disposed in a plane perpendicular to the axis of the weapon, represented by arrow 14. Its opposite sides **15*f* and 15*a* designate its directions of travel, i.e. fore and aft. Shown extending from fore side 15*f* is a striker 16, the tip of which 16*t* acts as the firing pin. A guide arm 18 extends from one end of the plate 15. Guide arm 18 usually slides under the weapon's bolt 19 to guide the striker 16** into its related hole in the bolt.

A generally cylindrically shaped post 20 extends perpendicularly from side **15*a* through a hole 20*a* in the plate 15. The function of this post is to support one end of a striker assembly return spring 22. The aft end of spring 22, as well as the aft end of a bolt return spring 24 are supported by aft block 13. The fore end of spring 24 extend into the carbine's bolt 19 through hole 19*a***.

As is known when the bolt 19 moves aft it abuts side **15*f* of the plate 15 and moves it aft as well. There is a minimum travel requirement for the bolt. In the case of the Uzi carbine, it is about 54 mm. In this firearm the plate 15 cannot be pushed by the bolt's aft end 19*h* nearly to the end of the body. This is due to the fact that post 20 as well as aft block 13 have finite lengths. Consequently the closest the bolt 19 can reach the end of the body is a distance about equal to the thickness of plate 15, the length of post 20 and the length dimension of block 13**, for a total length of about 70–80 mm. Adding a bolt travel distance of about 54 mm, and the length of the bolt itself one reaches a body length on the order of about 300 mm.

In the Uzi carbine the distance between the sides of the body near the fore end is reduced to accommodate a handgrip. In this body section the width is less than the bolt width. Thus, the bolt cannot travel to the fore end of the body, thereby further increasing the required body length, to that presently used, on the order of 370 mm. It is to greatly reduce the required body length, that the present invention is directed. The reduced body length of the Uzi carbine enables the use of its basic mechanism to a semi-automatic pistol.

In accordance with one aspect of the present invention a novel striker assembly is provided so that effectively the bolt is free to travel aft up to practically the rear end of the body. It is this feature which greatly contributes to body length reduction. This aspect of the invention may best be described in connection with FIGS. 2 and 3 wherein elements like those previously described are designated by like numerals.

Figure 2:
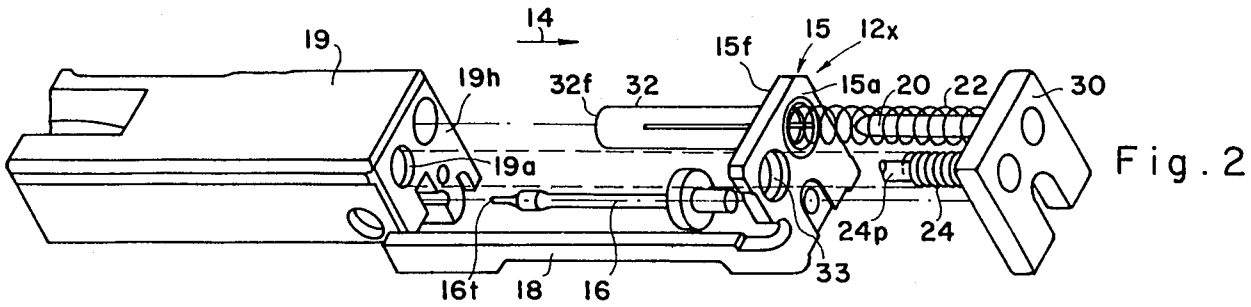
FIG. 2 is an expanded view of elements in the body of the novel Uzi pistol.

In the improved striker assembly designated **12*x* in FIG. 2, the striker 16 with tip 16*t* is the same as in the prior art. It is supported by the plate 15 and points toward bolt 19. Likewise a guide arm 18 is included. The major differences however are in the manner in which the striker assembly return spring 22 is supported. Basically the post 20 which supports the spring does not extend aft of the plate, as in FIG. 1. Rather it extends fore toward the bolt from a thin end plate 30. The spring 22 is wound about the post and through a hole 31 in plate 15, extends into a hollow sleeve 32, closed at its fore end 32*f*. As to the bolt return spring 24 it is wound about a long post 24*p* which is also supported at the aft end by plate 30. The post 24*p* and spring 24 extend through hole 33 in plate 15 and into bolt 19 through hole 19***a*.

Figure 3:
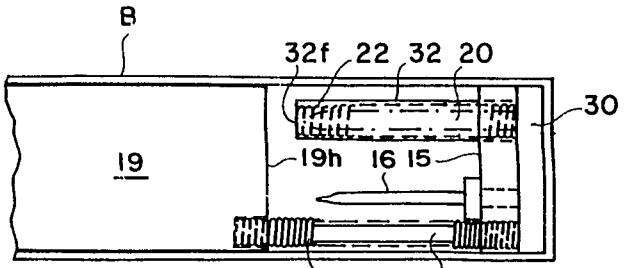
FIG. 3 is a partial top view of the Uzi pistol body in the tripped state with the novel striker assembly.

In practice after a bullet is fired the gases push bolt 19 aft as indicated by arrow 14. The bolt in turn pushes the plate 15 aft until it abuts end plate 30, sleeve 32 being received by a hole or bore 19*h*. Thus the bolt 19 can reach the end of the body save the total thickness of plates 15 and 30. See FIG. 3. As the bolt and the striker assembly move aft they compress springs 22 and 24. At the end of the travel the bolt returns fore by the spring 24. As to the striker assembly 12*x* as shown in FIG. 3, it remains aft next to plate 30 due to the sear lever. Thus the spring 22 remains compressed in sleeve 32. However, once the trigger is pressed the spring 22 pushes the striker assembly 12*x* toward bolt 19. Finally the striker tip 16*t* strikes the bullet's detonator and the bullet is fired.

From the foregoing it should thus be appreciated that with the novel striker assembly 12*x* the bolt can travel closer to the rear end of the body 13 and thus body length is greatly reduced. Body length is further reduced by reducing the bolt length. A third aspect of body length reduction is achieved by forming the body so that its walls from back to front are parallel and of equal distance. That is as viewed from the top of the body, it is in the shape of a rectangle. When the bolt is urged fore by its spring 24 it effectively reaches the front end of the body to which the barrel is threaded. Thus, total use is made of the body which can be made of minimum needed length. It is such body utilization that has enabled the highly popular Uzi carbine to be converted into a semi-automatic pistol.

Although particular embodiments of the invention have been described and illustrated herein, it is recognized that modifications and variations may readily occur to those skilled in the art and consequently, it is intended that the claims be interpreted to cover such modifications and equivalents.

I claim:

1. In a semi-automatic blowback pistol including a bolt having a rearmost face that drives aft ahead of it from a forward firing position to a rearward cocked position a striker assembly, the striker assembly comprising a striker plate extending in a plane perpendicular to its aft and fore motions and supporting a striker pin extending toward said bolt and further comprising a first return spring, the improvement comprising a hollow cylindrical sleeve with a closed front end extending toward the bolt from a hole in said striker plate, said closed front end of said sleeve being disposed aft of said bolt rearmost face when said striker assembly is in its cocked position, a substantially stationary end plate supporting a first post on which one end of said first return spring is supported, the first return spring extending over said first post and into said sleeve through said hole, wherein when said striker assembly moves aft to said cocked position said first post and first return spring enter said sleeve, means in the bolt, for accommodating said sleeve when the bolt moves aft, a body, said bolt moving forwardly and rearwardly in said body, said end plate being disposed at the rearward end of said body and supporting forwardly extending first and second post assemblies, said second post assembly including said first post and said first return spring with said first return spring mounted concentrically about said first post, and said first post assembly including a further post with a further return spring mounted concentrically about said further post, said further post of said first assembly being longer than said first post of said second assembly, said striker plate being disposed between said bolt and said end plate, and including first and second openings, said first and second post assemblies being aligned with, and passing through, respective ones of said first and second openings, and means, in said bolt, for accommodating said sleeve when said striker assembly moves forward to said firing position, wherein when said striker assembly moves to said cocked position, said striker plate abuts said end plate and said hollow sleeve is disposed rearwardly of said bolt rearmost face, and when said striker assembly moves to said firing position, said striker plate is spaced from said end plate and abuts said bolt rearmost face.

2. The pistol of claim 1, said hollow sleeve and said striker pin being provided at adjacent locations on said striker plate.

3. The pistol of claim 2, said hollow sleeve extending further fore than said striker.

4. The pistol of claim 3, said second post assembly extending further fore than said striker when said striker plate is in the cocked position.

5. In a semi-automatic blowback pitol including a bolt having a rearmost face that drives aft ahead of it from a forward firing position to a rearward cocked position a striker assembly, the striker assembly comprising a striker plate extending in a plane perpendicular to its aft and fore motions and supporting a striker pin extending toward said bolt and further comprising a first return spring, the improvement comprising a hollow cylindrical sleeve with a closed front end extending toward the bolt from a hole in said striker plate, said closed front end of said sleeve being disposed aft of said bolt rearmost face when said striker assembly is in its cocked position, a substantially stationary end plate supporting a first post on which one end of said first return spring is supported, the first return spring extending over said first post and into said sleeve through said hole, wherein when said striker assembly moves aft to said cocked position said first post and first return spring enter said sleeve, means in the bolt, for accommodating said sleeve when the bolt moves aft, and a bolt return spring arranged between said bolt and said end plate, and to pass through a respective part of said striker plate.

* * * * *